US005156171A

United States Patent [19]

Goodman

[11] Patent Number: 5,156,171

[45] Date of Patent: Oct. 20, 1992

[54] METHOD OF ADORNING A PONY TAIL AND PONY TAIL HOLDER

[75] Inventor: Joyce E. Goodman, New York, N.Y.

[73] Assignee: Goody Products, Inc., Kearny, N.J.

[21] Appl. No.: 766,341

[22] Filed: Sep. 27, 1991

[51] Int. Cl.[5] ..... A45D 24/00

[52] U.S. Cl. ..... 132/200; 132/275; 132/273

[58] Field of Search ..... 132/273, 275, 200; 2/174

[56] References Cited

U.S. PATENT DOCUMENTS

| | | | |
|---|---|---|---|
| D. 292,030 | 9/1987 | Revson | D28/41 |
| D. 315,036 | 2/1991 | Leopold | D28/41 |
| 2,241,855 | 5/1941 | Heisterberg | 2/174 |
| 2,420,916 | 5/1947 | Sorge | 2/174 |
| 5,044,385 | 9/1991 | Rhodes | 132/275 X |

FOREIGN PATENT DOCUMENTS 0016445 of 1894 United Kingdom ..... 132/273

OTHER PUBLICATIONS

"Ribbonbands" brochure; one page; Colleen Larkin, 1722 Blake Street, Berkeley, Calif. 94703.

Specification as filed, Des. Pat. 292,030 (cited above) Ser. No. 940,636, filed Dec. 11, 1986.

*Primary Examiner*—John J. Wilson

*Assistant Examiner*—Jeffrey A. Smith

[57] ABSTRACT

Pony tail holders are disclosed including a relatively wide fabric ring having a tubular annulus around a central hole, and an elastic ring in the tubular annulus, the elastic ring having a portion that is readily grasped, as by having a knob such as a bead, for pulling a loop of the elastic ring outside of the fabric ring. The fabric ring, with its contained portion of the elastic ring, can encircle a pony tail once and grip the pony tail and said loop of the elastic ring outside the fabric ring can encircle and grip the pony tail separately.

19 Claims, 2 Drawing Sheets

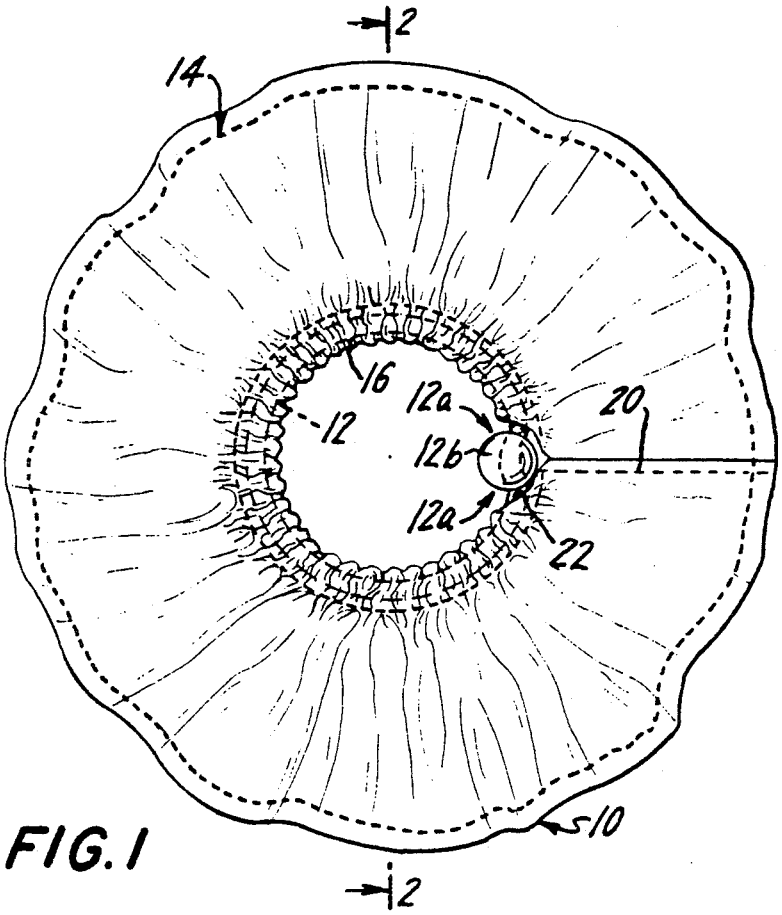
FIG. 1
FIG. 2
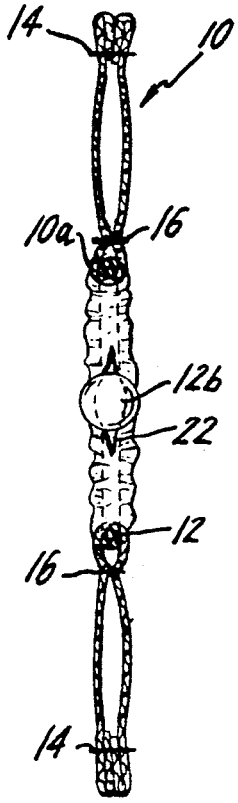
FIG. 3
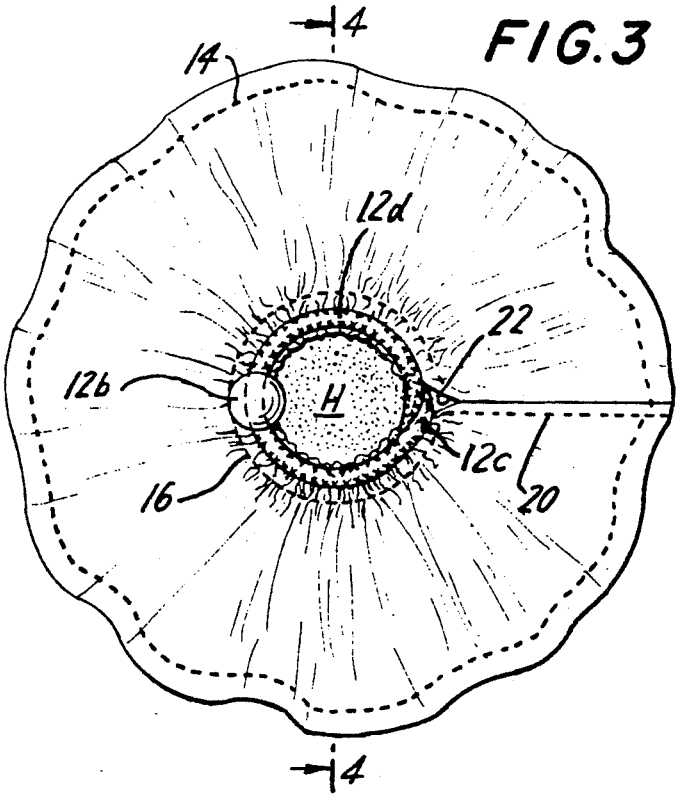
FIG. 4
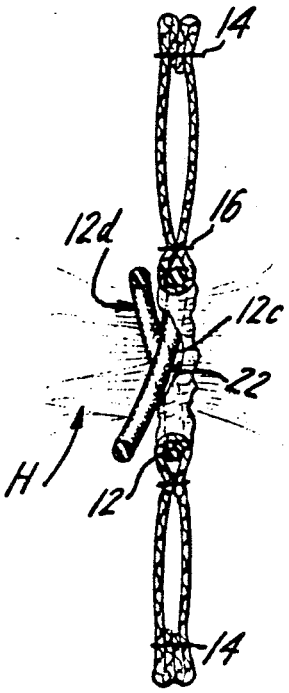

FIG. 6
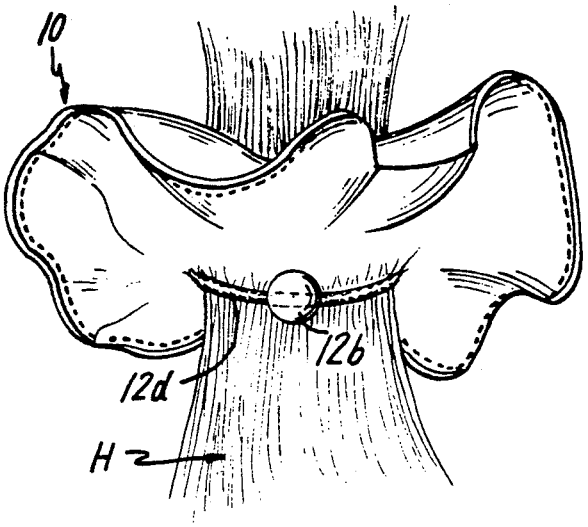
FIG. 5
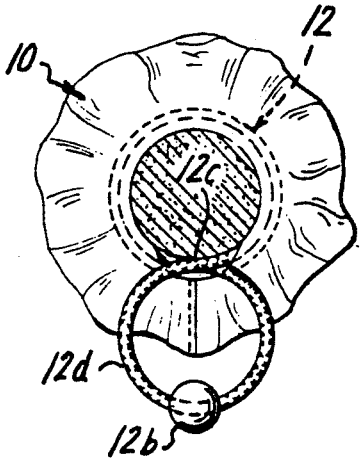
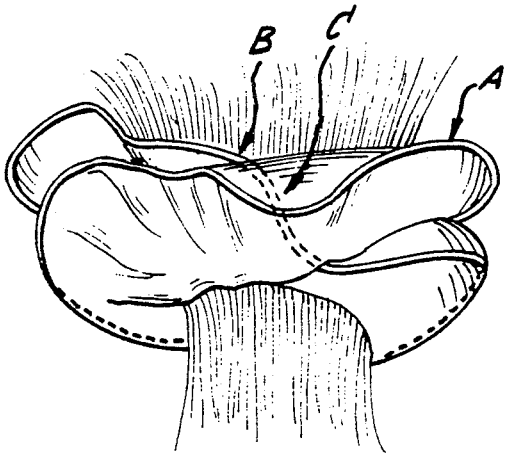
FIG. 7
(PRIOR ART)
FIG. 8
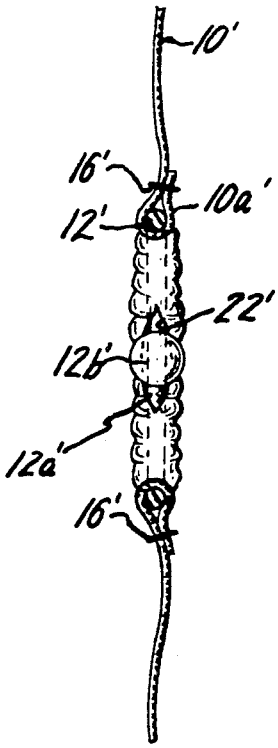

METHOD OF ADORNING A PONY TAIL AND PONY TAIL HOLDER

The present invention relates to a form of hair ornament known as a pony tail holder.

BACKGROUND OF THE INVENTION

A well known form of pony tail holder involves a generously proportioned fabric ring and an elastic ring that is slidably contained in the fabric ring. One known form of pony tail holder is made of a strip of fabric; the longitudinal edges of the fabric strip are stitched together, resulting in a fabric tube; and the ends of the tube are stitched together to constitute a tubular annulus. The elastic ring is wholly contained in the tubular annulus. The fabric ring when fully extended is very much longer than the elastic ring in its unstretched condition, so that the fabric becomes gathered into many folds.

Another known form of pony tail holder, also having a generous fabric ring and an elastic ring, is made of a wide strip of fabric; a relatively narrow portion of the strip's width is folded over and sewn to the wide remainder of the strip's width, in this way forming a relatively narrow tubular passage. The elastic ring is contained in the tubular passage. That portion of the fabric ring which encloses the elastic ring is wrinkled or tightly gathered, and many loose folds or undulations are formed in the area of the fabric that extends outward of the tightly gathered portion of fabric.

In use, each of those hair ornaments is stretched considerably to form a very large fabric-and-elastic loop (the elastic becoming stretched and sliding relative to the fabric as the gathered fabric becomes extended) and the large loop is twisted to form a "FIG. 8"; and the pony tail is drawn through each of the two small loops of the "FIG. 8". The end result is that two loops of fabric folds extend around the pony tail, one loop (and its enclosed elastic) crossing over and crushing the other loop of fabric folds. The bunching of the fabric at the cross-over is so severe that the decorative effect is impaired, especially if the fabric has a printed design.

SUMMARY OF THE INVENTION

Novel pony tail holders are provided that share some of the traits of the pony tail holders described above, but the novel pony tail holders represent an improvement in several respects. Each novel pony tail holder is adapted to be worn as a ring extending only once around a pony tail. Notably, its decorative effect is unimpaired by the cross-over that characterizes the above-described gathered fabric pony tail holder that rely on an internal elastic band to tighten the pony-tail holder on a pony tail. Moreover, because the gathered fabric surrounds the pony tail only once, the length of the fabric strip needed in making it is inherently much less than an equally gathered fabric strip that is to encircle a pony tail twice. In the novel pony tail holder, the length of the elastic band, both when unstretched and when stretched to a maximum, can be the same as in the known pony tail holders described above. It is as easy or easier to put on a novel pony tail holder, and to take it off, as comparably proportioned heretofore-known pony tail holders.

In the illustrative forms of novel pony tail holders described in detail below, an elastic ring (or a portion of the elastic ring as explained below) is disposed slidably in a tubular fabric annulus. A portion of the elastic ring is exposed at an opening in the fabric in such a manner as to be readily grasped. The readily grasped portion of the elastic ring may be an exposed ample length of elastic, or it may comprise an exposed bead or other form of knob.

In use, the readily grasped portion of the elastic ring is pulled, to draw a loop of the elastic ring out of its enclosing fabric. A loop portion of the elastic ring remains in the fabric ring. A pony tail is drawn through the central hole of the fabric ring; the elastic loop that was drawn out of the fabric ring as an external loop is then stretched, given a half-twist, and looped around the pony tail. The decorative effect of the fabric ring, extending once around the pony tail, is unimpaired by the cross-over that characterizes prior art pony tail holders. An added decorative effect is provided by making the external loop of the elastic band prominent, its color matching or contrasting with the fabric, and a striking bead or other knob also enhances the decorative effect.

The nature of the invention and some of its variants will be best understood from the following detailed description of two illustrative embodiments, shown in the accompanying drawings that form part of the disclosure.

THE DRAWINGS

FIG. 1 is a front view of a novel pony tail holder in a stored condition drawn approximately to full scale;

FIG. 2 is a cross-section of the pony tail holder of FIG. 1 at the plane 2—2 in FIG. 1;

FIG. 3 is a front view of the pony tail holder of FIGS. 1 and 2 in use on a pony tail that is shown in cross-section;

FIG. 4 is a cross-section of the pony tail holder of FIG. 3 at the plane 4—4 in FIG. 3;

FIG. 5 is a front view of the pony tail holder of FIGS. 1–4, in a condition partway from that of FIG. 1 to that of FIG. 3, drawn to reduced scale;

FIG. 6 is a side view of the pony tail holder of FIGS. 1–5, on a pony tail;

FIG. 7 is a side view of a known form of pony tail holder having the customary two loops of fabric encircling a pony tail; and FIG. 8 is a cross-section like FIG. 2, of a modification of the novel pony tail holder of FIGS. 1–6.

DETAILED DESCRIPTION OF ILLUSTRATIVE EMBODIMENTS

FIGS. 1 and 2 show a novel pony tail holder as it appears when not in use, including a fabric ring 10 containing an elastic ring 12 in its unstretched condition. A portion **12*a* of the elastic ring is exposed so as to be readily grasped. To make portion 12*a* easily grasped, that exposed portion may be prominently long or it may be thick or it may have a knot, or exposed portion 12*a* may combine these traits. In the form shown, exposed bead 12*b* is part of ring 12**, making the exposed portion readily grasped.

Fabric ring 10 is formed of a strip of fabric, being 14 inches long by 4 inches wide in an example. It is folded along its longitudinal center line. The edges are folded in, and the four layers of fabric are joined by a row of stitches 14.

The fabric tube is flattened. A row of stitches 16 is made relatively far from one of the margins and close to, but spaced from, the other of the margins of the flattened fabric tube, in this way, a tubular passage 10*a* is formed for the elastic ring. In an example, the width of the tubular passage 10*a* is about 1/5 of the width of the fabric ring when flattened. Rows of stitches 14 and 16 have the effect of holding the opposite layers of the flattened fabric tube close to each other. For developing a somewhat different appearance, the row of stitches 16 may be omitted, and the fabric tube then constitutes a tubular passage in which the elastic ring is enclosed.

The ends of the fabric tube are brought together and joined by stitching 20, either in a manner that holds the opposite layers of the fabric tube together, or so that the tubular nature of the fabric tube is preserved at that stitching. In any event, an opening 22 is allowed to remain, or it is separately formed, so that portion 12*a*, 12*b* of an elastic ring will be exposed.

Elastic ring 12 comprises a length of elastic of any suitable form. Multiple elastic filaments may be unified by transverse threads to form a well-known narrow and flat elastic band. Also, ring 12 may comprise a relatively thick cord or core of rubber. The rubber core may have an extensible fabric cover such as a braid of textile fibers, a well-known form of elastic that is used alone in some pony tail holders.

A length of elastic band is threaded through the tubular passage 10*a* formed by the row of stitching 16. This may be done either before or after the ends of the fabric tube are joined for constituting the fabric ring. After the ends of the fabric tube are joined, passage 10*a* constitutes a tubular annulus for the elastic. Ends of a suitable length of the elastic are joined, by a knot or by stitching, or by a fastener that forms an easily grasped knob. The circumferential length of the elastic ring that is formed in this manner is constant in its unstretched condition due to the knot, stitching or other fixed joint that makes a ring of the elastic band. The circumferential length of the elastic ring is changed only by stretching the elastic band. In the form shown, bead 12*b* is threaded onto the elastic before its ends are joined. In an example, the unstretched length of the elastic is half of the length of the fully extended fabric tube, the length of the elastic then being 7 inches for a fabric tube 14 inches long in the above example. The end result in the illustrative embodiment as shown in FIGS. 1 and 2 is a fabric ring that is closely gathered along the annular area containing the elastic ring, and a wavy area of double-thickness fabric outward of the closely gathered area.

To use the pony tail holder of FIGS. 1 and 2, the exposed portion 12*a*, 12*b* of the elastic ring is grasped and pulled, forming an external loop 12*d* of the elastic ring (FIG. 5) and leaving a loop of the elastic ring enclosed in the fabric. The immediate effect is to shrink the central hole of the pony tail holder. The elastic ring in FIGS. 1 and 2 is slidably contained in the fabric. This allows the external loop to be formed and it allows the elastic loop that remains within the fabric ring to shift in relation to the fabric, as the central hole shrinks. If the external loop is released, all or some part of that loop tends to remain outside the fabric ring. Friction between the elastic ring and the folds of the gathered fabric ring inhibits any tendency of the loop to retract into the fabric ring. The external loop may be present in the pony tail ring as it is sold. With the elastic loop extended, little if any instruction is needed for using the novel pony tail ring.

A pony tail is pulled through the central hole of the pony tail holder. The external loop of the elastic ring is pulled to tension the internal loop of the elastic ring and its enclosing fabric ring around the pony tail. The external loop of the elastic ring is then given a half-twist, and the pony tail is drawn through the external loop. The result is represented in FIGS. 3, 4 and 6. A cross-over 12*c* is formed between the internal loop of the elastic ring and external loop; the external loop becomes tensioned around the pony tail H.

Notably, the cross-over is formed only in the elastic ring and not the composite fabric ring and elastic ring. The fabric ring is not severely distorted and bunched at a cross-over, such as is characteristic of comparable prior art pony tail holders. FIG. 7 shows a conventional pony tail holder wherein one loop B of fabric and elastic encircles the pony tail 14 and (after a half-twist is formed) a second loop A of fabric and the enclosed elastic encircles the pony tail. Loop A crosses loop B, forming cross-over C in FIG. 7.

The bunched-up and severely wrinkled fabric at the cross-over is not apparent in FIG. 7 which is intended to show the cross-over clearly. The fabric at the cross-over obscures any print that the fabric may have and, in any case, the cross-over of the fabric-and-elastic ring tends to detract from the overall appearance achieved (FIG. 6) when the cross-over involves only the elastic ring. The external loop 12*d* of the elastic ring and bead 12*b* are best colored to match or contrast with the fabric ring so as to enhance the decorative result.

If necessary (for pony tails that are unusually slender) after one portion of the external loop 12*d* has encircled the pony tail, a remaining portion of the external loop can be given another half-twist and then stretched around the pony tail.

A further modification is shown in FIG. 8. There, a ribbon or band of fabric has a marginal area folded over elastic ring 12' and secured by stitching 16'. The fold forms an enclosing annular tube 10*a'* for the elastic, except for the readily grasped knob 12*b'* on that portion 12*a'* of the elastic band which remains exposed at an opening 22' in the fabric. While opening 22' is shown as a slit in the fabric, in practice stitching 16' may extend incompletely around the center hole of the fabric ring, leaving a short unstitched gap at which the easily grasped portion of the elastic ring (including knob 12*b'*) is exposed. That gap is conveniently provided where the ends of the fabric strip are joined to form fabric ring 10'.

Other modifications of the embodiments described above will readily occur to those skilled in the art. For example, stitches 14 may be omitted so that separate layers of the fabric ring extend around the pony tail, yet one fabric ring does not cross the other. Also, the annular area that extends outward of tubular passage 10*a* (FIG. 2) and which involves two layers of fabric in the embodiment of FIGS. 1–6 may be slit radially into many narrow elements, suggestive of the petals of some flowers; and the annular area of fabric extending outward of the tubular passage 10*a'* in the embodiment of FIG. 8 may correspondingly be subdivided for a modified decorative effect. Consequently, the invention should be construed broadly in accordance with its true spirit and scope.

I claim:

1. A pony tail holder including a fabric ring having an annular area at least a portion of which comprises a tubular annulus around a central hole in which a pony tail is to be gripped, and an elastic ring largely contained slidably in said tubular annulus, said elastic ring having a readily grasped portion exposed at an opening in the tubular annulus, the radial extent of the fabric ring outward of said central hole being vastly greater than that of said elastic ring, a first loop of the elastic ring being adapted to be pulled out of the fabric ring while a second loop of the elastic ring remains enclosed in the fabric ring and constricts said central hole, whereby a pony tail may be encircled once by said fabric ring and said second loop, and whereby the pony tail may be encircled separately by said first loop of the elastic ring.

2. A pony tail holder as in claim 1, wherein said fabric ring is formed of a strip of fabric whose longitudinal edges are sewn together so as to form a fabric tube and whose ends are sewn together to form the fabric ring.

3. A pony tail holder as in claim 1, wherein said fabric ring is formed of a strip of fabric whose longitudinal edges are sewn together so as to form a fabric tube and whose ends are sewn together to form the fabric ring, the width of said tubular annulus, measured when flattened, being less than about one-fifth of the width of said tube, measured when flattened.

4. A pony tail holder as in claim 1, wherein said fabric ring is formed of a strip of fabric whose longitudinal edges are sewn together so as to form a fabric tube and whose ends are sewn together to form the fabric ring, said tubular annulus resulting from a row of stitches through opposite layers of the fabric tube when flattened, said row of stitches being closer to said central hole than to the periphery of the ring.

5. A pony tail holder as in claim 1, wherein said readily grasped portion of the elastic ring comprises a knob.

6. A pony tail holder as in claim 1, wherein the fabric ring comprises a strip of fabric, a relatively narrow portion of whose width forms said tubular annulus and the remainder of whose width extends outward of said tubular annulus as two thicknesses of fabric.

7. A pony tail holder as in claim 6, wherein said readily grasped portion of the elastic ring comprises a knob.

8. A pony tail holder as in claim 1, wherein the fabric ring comprises a strip of fabric, a relatively narrow portion of whose width forms said tubular annulus and the remainder of whose width extends outward of said tubular annulus as a single layer of fabric.

9. A pony tail holder as in claim 8, wherein said readily grasped portion of the pony tail holder comprises a knob.

10. A pony tail holder as in claim 1 wherein said elastic ring comprises an elastic band having opposite extremities joined together so as to form an elastic ring whose circumferential length is constant in its unstretched condition.

11. A pony tail holder including a fabric ring having an annular area at least a portion of which comprises a tubular annulus around a central hole, and an elastic ring having an internal first loop slidably contained in said tubular annulus and an external second loop outside of said tubular annulus, the width of the fabric ring measured outward of said central hole being vastly greater than that of said elastic ring, the length of said internal loop being reducible by pulling the external loop so as to increase its length as a fraction of the length of the whole elastic ring, whereby a pony tail may be encircled once and gripped by the fabric ring and said internal loop of the elastic ring and whereby the pony tail may be encircled and gripped by said external loop of the elastic ring.

12. A pony tail holder as in claim 11, wherein the fabric ring comprises a strip of fabric, a relatively narrow portion of whose width forms said tubular annulus and the remainder of whose width extends outward of said tubular annulus as two thicknesses of fabric.

13. A pony tail holder as in claim 12, wherein said second loop of the elastic ring has a knob at the portion of said second loop that is farthest from said first loop.

14. A pony tail holder as in claim 11, wherein the fabric ring comprises a strip of fabric, a relatively narrow portion of whose width forms said tubular annulus and the remainder of whose width extends outward of said tubular annulus, at least largely as a single layer.

15. A pony tail holder as in claim 14, wherein said second loop of the elastic ring has a knob at the portion of said second loop that is farthest from said first loop.

16. A pony tail holder as in claim 11, wherein said second loop of the elastic ring has a decorative readily grasped knob.

17. A pony tail holder as in claim 11 wherein said elastic ring comprises an elastic band having opposite extremities joined together so as to form an elastic ring whose circumferential length is constant in its unstretched condition.

18. In a pony tail holder of the type including a fabric ring at least a portion of which comprises a tubular annulus around a central hole, and an elastic ring in said tubular annulus, the radial extent of the fabric ring outward of the central hole being vastly greater than that of the elastic ring, the improvement wherein the tubular annulus encloses most of the elastic ring and has an opening that exposes a readily gripped portion of the elastic ring, so that a first loop of the elastic ring can readily be pulled out of the fabric ring for constricting the central hole while a second loop of the elastic ring remains in the fabric ring, whereby a pony tail may be encircled by said fabric ring containing said second loop of the elastic ring and encircled separately by said first loop of the elastic ring.

19. The method of adorning a pony tail with a pony tail holder that comprises a fabric ring having a tubular annulus and an elastic ring having an internal first loop contained in the tubular annulus and having an externally accessible portion, including the steps of the pulling a pony tail through the fabric ring, drawing on said externally accessible portion of the elastic ring to tension the internal loop of the elastic ring around the pony tail and to provide a tensioned external loop of the elastic ring, giving the external loop of the elastic ring a twist, pulling the pony tail through that tensioned external loop of the elastic ring, and releasing the tensioned external loop.

* * * * *